United States Patent [19]

Pilat

[11] 4,204,844

[45] May 27, 1980

[54] LIQUID TRANSFER SYSTEM FOR CONDUCTIVE LIQUIDS

[76] Inventor: Michael J. Pilat, 7306 57th Ave. N.E., Seattle, Wash. 98115

[21] Appl. No.: 894,179

[22] Filed: Apr. 6, 1978

Related U.S. Application Data

[63] Continuation-in-part of Ser. No. 752,988, Dec. 21, 1976, abandoned, which is a continuation-in-part of Ser. No. 492,157, Jul. 26, 1974, abandoned.

[51] Int. Cl.[2] ..... B03C 3/01; B03C 2/16; B03C 3/84

[52] U.S. Cl. ..... 55/10; 55/8; 55/107; 55/120; 55/122; 55/126; 55/227; 55/229; 55/135; 361/228

[58] Field of Search ..... 55/7, 8, 10, 13, 106, 55/107, 117, 120, 122, 124, 126, 138, 227, 229, 135, 282; 174/8; 361/227-229; 239/3, 15; 118/600, 602; 310/71

[56] References Cited

U.S. PATENT DOCUMENTS

| | | | |
|---|---|---|---|
| 1,329,859 | 2/1920 | Schmidt et al. | 55/135 |
| 1,399,441 | 12/1921 | Peterson | 55/117 |
| 1,413,877 | 4/1922 | Schmidt | 55/124 |
| 1,983,366 | 12/1934 | Harlow | 55/10 |
| 2,001,700 | 9/1935 | Barthel | 55/107 |
| 2,207,576 | 7/1940 | Brown | 55/10 |
| 2,351,089 | 6/1944 | Abbey | 55/108 |
| 2,357,354 | 9/1944 | Penney | 55/107 |
| 2,525,347 | 10/1950 | Gilman | 55/107 |
| 2,696,892 | 12/1954 | Campbell | 55/8 |
| 2,763,125 | 9/1956 | Kadusch et al. | 55/2 |
| 2,788,081 | 4/1957 | Ransburg | 55/107 |
| 2,789,658 | 4/1957 | Wintermute | 55/100 |
| 2,931,459 | 4/1960 | Wiles et al. | 55/227 |
| 2,949,168 | 8/1960 | Peterson | 55/107 |
| 3,098,890 | 7/1963 | Peterson | 174/8 |
| 3,122,594 | 2/1964 | Kielback | 55/233 |
| 3,218,781 | 11/1965 | Allemann et al. | 55/138 |
| 3,309,915 | 3/1967 | McEven et al. | 55/146 |
| 3,331,192 | 7/1967 | Peterson | 55/124 |
| 3,370,646 | 2/1968 | Hopper | 55/1 |
| 3,635,157 | 1/1972 | Taylor et al. | 317/3 |
| 3,773,966 | 11/1973 | Ebert et al. | 55/120 |
| 3,807,137 | 4/1974 | Rommell | 55/107 |
| 3,837,915 | 9/1974 | Erb | 317/3 |
| 3,877,898 | 4/1975 | Sakai et al. | 55/122 |
| 3,899,308 | 8/1975 | Peterson | 55/122 |
| 3,926,586 | 12/1975 | Matts | 55/122 |
| 3,960,505 | 6/1976 | Marks | 55/10 |

FOREIGN PATENT DOCUMENTS

| | | | |
|---|---|---|---|
| 538980 | 11/1931 | Fed. Rep. of Germany | 55/128 |
| 940065 | 12/1948 | France | 55/282 |
| 686779 | 1/1953 | United Kingdom | 55/107 |

*Primary Examiner*—David L. Lacey
*Attorney, Agent, or Firm*—Christensen, O'Connor, Johnson & Kindness

[57] ABSTRACT

A transfer system for transferring a conductive liquid from a reservoir of the liquid at a first electric potential to receiving equipment which charges the liquid to a second electric potential includes a sump, pump, inlet piping to the sump from the reservoir, and outlet piping from the sump to the receiving equipment. The inlet piping is electrically isolated from the sump. The conductive liquid is introduced into the sump in an interrupted stream to provide electrical isolation between the liquid in the reservoir and the liquid in the sump. The flow of liquid to the sump is controlled by a sensor system to maintain a predetermined level of liquid within the sump.

17 Claims, 7 Drawing Figures

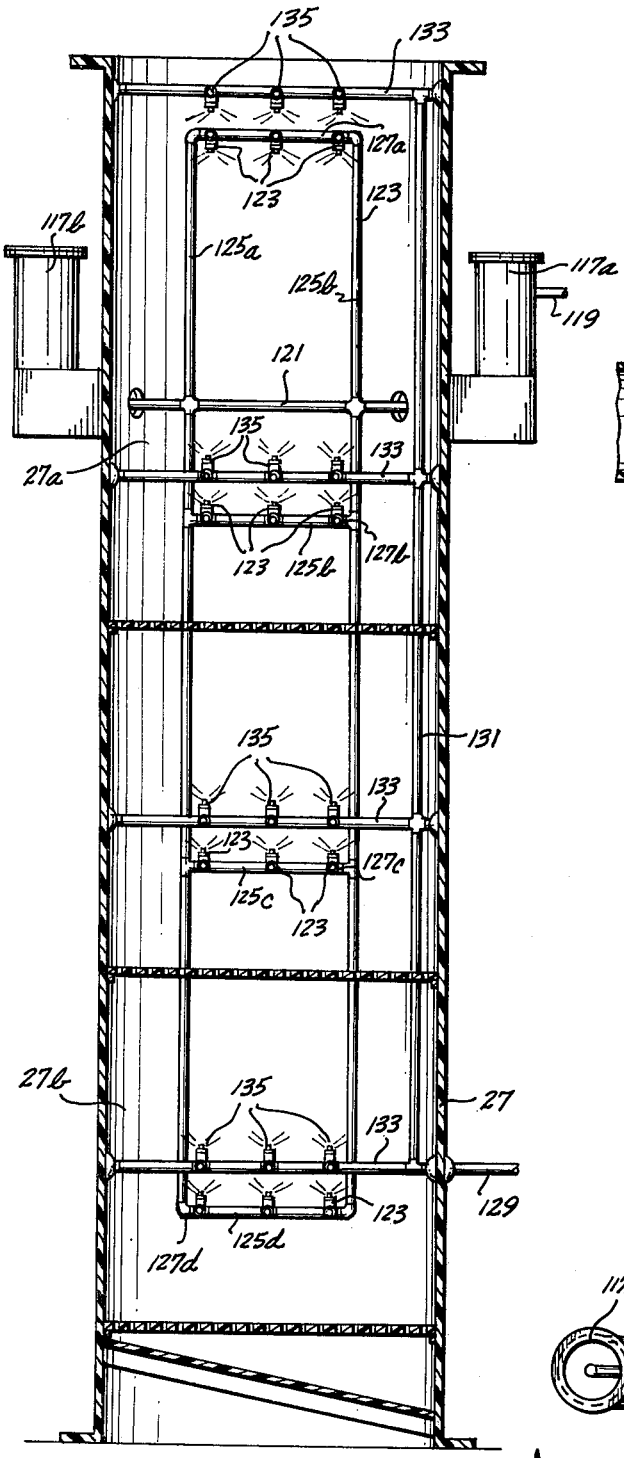
Fig. 4.
Fig. 3.
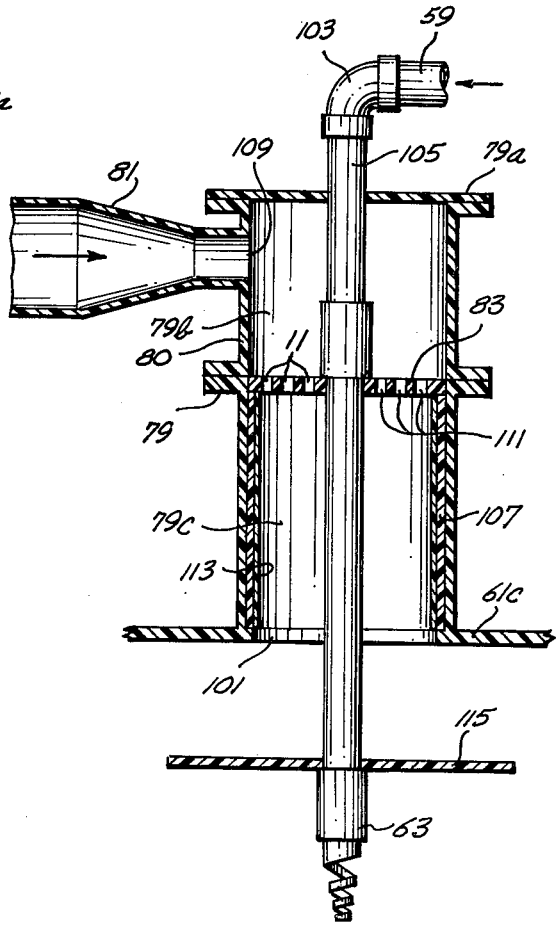
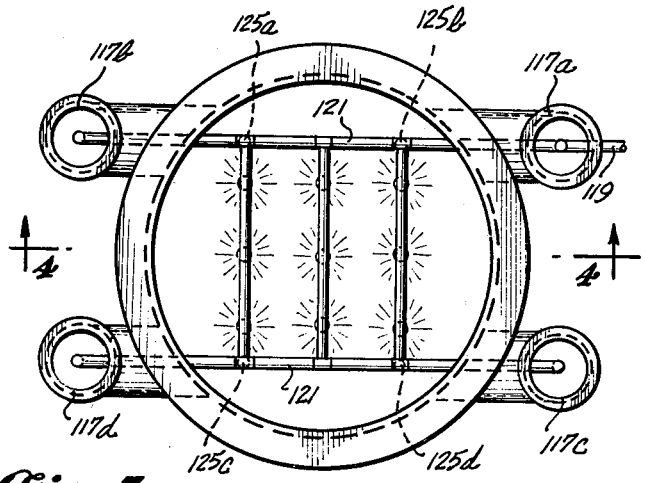
Fig. 5.

LIQUID TRANSFER SYSTEM FOR CONDUCTIVE LIQUIDS

BACKGROUND OF THE INVENTION

This application is a continuation-in-part application of U.S. patent application Ser. No. 752,988, filed Dec. 21, 1976, and now abandoned which is in turn a continuation-in-part application of U.S. patent application Ser. No. 492,157, filed July 26, 1974 and now abandoned.

The invention relates to liquid transfer systems for recycling liquid and supplying liquid to receiving equipment. The invention more particularly relates to a electrically isolating transfer system for transferring liquid from a reservoir to receiving equipment which charges the liquid to a high electrical potential, which transfer system maintains electric isolation between the liquid in the reservoir and the charged liquid in the receiving equipment.

There are many environments in which it is either necessary or desirable to charge a conductive liquid to a high electric potential. Whenever a conductive liquid in one of these environments is charged to a high electric potential, the possibility exists that the charge will be conducted back through the liquid to its source of supply, thereby endangering other users of the same source of supply and also endangering personnel working directly with the supply system. One example of such an environment is the wet electrostatic scrubber described in my patent application Ser. No. 752,988 now abandoned. In an elecrostatic scrubber, as described in the above-referenced patent application, particles charged to a first electrical potential and entrained in a stream of gas are injected into a spray tower and brought into contact with droplets of a liquid that is charged to a second, opposite electrical potential. The charged particles are attracted by the oppositely charged liquid droplets and are removed from the gas stream. The droplets collect on the electrically grounded walls of the spray tower and run down the walls to a collecting reservoir. Prior art systems have utilized nonconductive pipes and low conductivity liquid to isolate the liquid supply from the electrical charging mechanism. In many of these systems, the inlet piping to the electrical charging mechanism is formed in a coil or other shape to increase the length of the path between the supply of uncharged liquid and the charging point in order to dissipate the electrical charge flowing back from the charging point to the supply by resistive loss in the low conductivity fluid. There are disadvantages in such a system in that a slight change in the chemical properties of the liquid, for example an increase in salinity where the liquid being used is water, can substantially increase the conductivity of the liquid, thereby eliminating the resistive dissipation and exposing other water users upstream from the supply point to the danger of electrical shock.

It has been found when using an electrostatic scrubber, as described above, that the efficiency of particle removal from the gas stream is increased when using recycled scrubbing liquid rather than plain tap water. The increased efficiency is a result of the increased conductivity of the recycled liquid which contains some impurities within it. The use of a higher conductivity liquid is directly contrary to the principles of electrical isolation utilized in the prior art, that is, in the resistive dissipation procedure described above. Also, by utilizing recycled liquid there is a substantial reduction in the amount of liquid used in the particulate removal process, thereby reducing operating costs. However, the liquid which is collected in the reservoir of the electrostatic scrubber is at ground potential and the liquid entering the electrostatic scrubber spray tower is charged to a potential other than ground. In order to maintain the difference in electrical potential it is necessary to electrically isolate the liquid in the reservoir from the liquid which is injected into the spray tower. If the electrical isolation is not maintained, it would be necessary to charge the walls of the spray tower and the reservoir to the same electrical potential as the liquid being introduced into the spray tower. The charging of the spray tower and reservoir walls is undersirable for at least two reasons. First, it would affect the operation and efficiency of the particulate removal process to alter the electrical potentials of the various elements in the system. If the internal walls of the spray tower and the injected liquid were maintained at the same potential (opposite to the charged particles entering the tower) the "space charge" created within the tower would have an equal pull in all directions on the individual charge particles. The end effect would be the same as having no charge on the injected liquid or tower. Second, if the entire spray tower and reservoir are charged to some electrical potential other than ground it will be necessary to provide greater protection for personnel working on the scrubber system to avoid electrical shock. It is, therefore, desirable to maintain the spray tower and reservoir at ground potential.

It is, therefore, an object of this invention to provide a liquid transfer system for supplying a conductive liquid to receiving equipment from a reservoir.

It is a further object of this invention to provide such a liquid transfer system that electrically isolates the liquid within the reservoir from the liquid entering the receiving equipment.

It is a further object of this invention to provide a liquid transfer system for recycling scrubbing liquid in a wet electrostatic scrubber.

BRIEF SUMMARY OF THE INVENTION

The liquid transfer system of the present invention transfers a conductive liquid at a first electrical potential from a supply of the conductive liquid to receiving equipment which charges the liquid to a second electrical potential. The transfer system isolates the liquid at the second potential from the liquid at the first potential and includes a containment means electrically isolated from the first potential for holding the liquid at the second potential and means for introducing the liquid at the first potential into the containment means. The means for introducing the liquid is electrically isolated from the second potential and introduces the liquid into the containment means along a nonconductive flow path. A pump means, electrically isolated from the first potential, is included for transferring the liquid from the containment means to the receiving equipment.

In the preferred embodiment of the invention the means for introducing the liquid includes a spray nozzle which injects the liquid into the containment means in an interrupted stream, for example as a plurality of droplets, thereby breaking the electrical continuity between the supply and the liquid within the containment means. Means are also included for surrounding the spray nozzle with a stream of heated clean nonconductive gas to prevent moisture buildup on the nozzle and also to remove any particulate matter which may collect on the spray nozzle.

Also in the preferred embodiment, a sensor means and associated valve means are installed on the inlet lines of the containment means to maintain a predetermined level of liquid within the containment means.

Further in the preferred embodiment, the pumping means is an AC electric motor-driven pump and the electric motor is DC isolated from its power source by an isolation transformer.

BRIEF DESCRIPTION OF THE DRAWINGS

The foregoing objects and other advantages of the invention will become more readily apparent to those skilled in the art and others after reading the following specification taken in conjunction with the attached drawings wherein:

FIG. 3 is a simplified side elevational view partly in section of an inlet spray nozzle used in the liquid transfer system shown in FIG. 2.

FIG. 4 is a simplified side elevational view partly in section of an electrostatic scrubber spray tower.

FIG. 5 is a plan view of an electrostatic scrubber spray tower.

DETAILED DESCRIPTION

Although the liquid transfer system provided by the present invention was initially developed for use with, and is described herein in the environment of, a wet electrostatic scrubber for removing particulates from a gaseous stream, it will be understood by those skilled in the art and others that an electrically isolating liquid transfer system constructed according to the principles of this invention can be used in any environment in which it is necessary or desirable to charge a conductive liquid to a high electrical potential while maintaining the charged liquid isolated from the source of uncharged liquid, for example, in a charged bubble scrubber in which the contaminated gases pass through a corona particle charger and then into a bubble cap or sieve plate tower containing electrically charged liquid.

Figure 1:
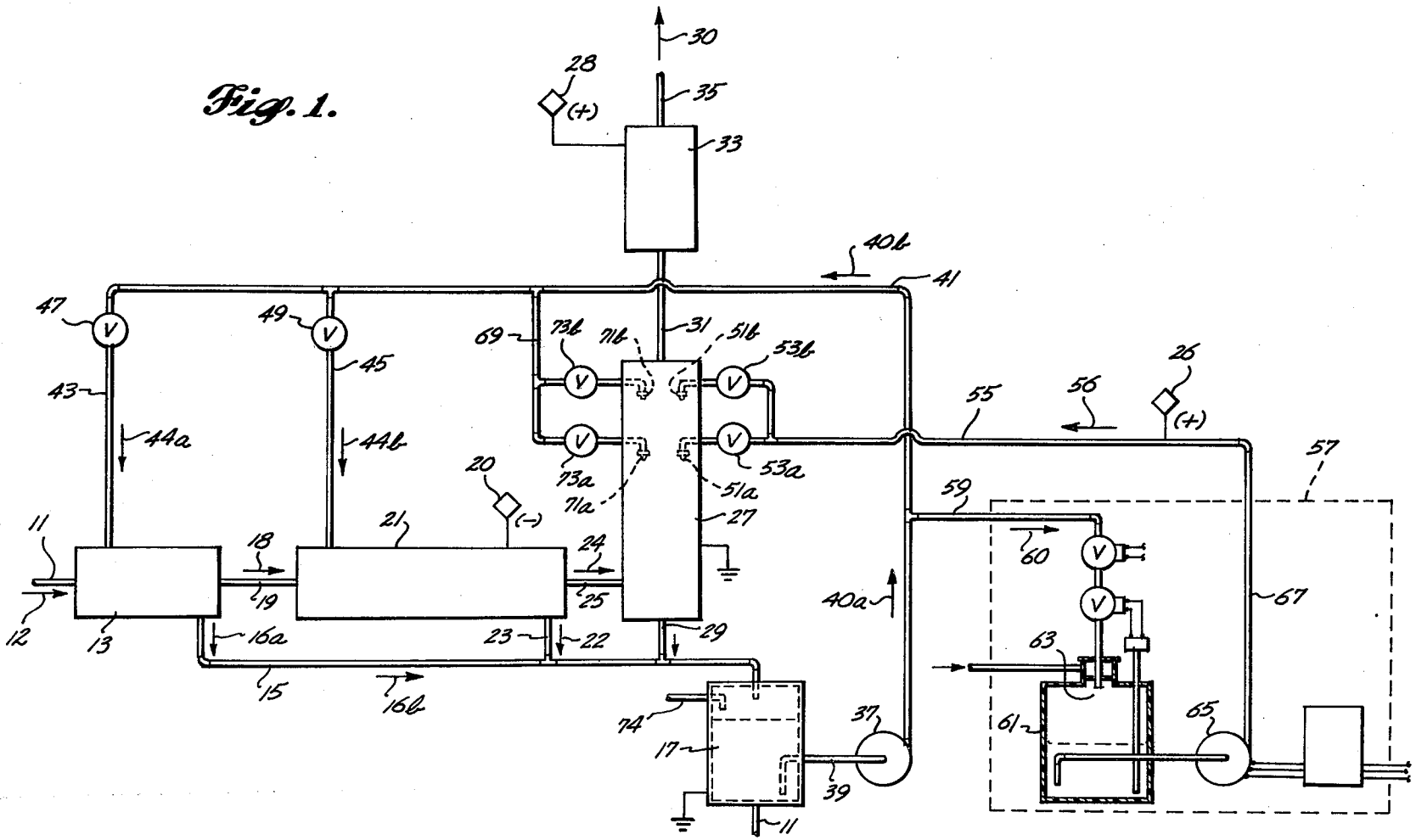
FIG. 1 is a diagram of a wet electrostatic scrubber system incorporating a liquid transfer system constructed in accordance with the principles of this invention.

Referring to FIG. 1, contaminated gases containing entrained particles, for example, exhaust gases from a pulping process, smelter, blast furnace or coal fired boiler (not shown), flow through a feeder pipe 11 in the direction shown by an arrow 12 into a gas cooling chamber 13. In the cooling chamber 13, the gas is washed with a liquid to lower its temperature. The gases are cooled in the cooling chamber 13 to reduce the volume of the gas and also the wear on the rest of the system which would be caused by high temperatures. Some of the larger particles are removed from the gas by the wash water and are carried to the bottom of the cooling chamber. The spent wash water and removed particles flow through a first drain pipe 15 coupled to the bottom of the cooling chamber 13 to a collecting tank 17 as shown by arrows 16*a* and 16*b*.

The cooled gas flows through a connecting pipe 19 from the cooling chamber 13 to a corona chamber 21 as shown by arrow 18. In the corona chamber 21 the particles in the gas are charged to some electrical potential by a first power supply 20. In a preferred embodiment the particles are charged to a negative potential in the range of −50 to −100 Kilovolts (Kv). The corona chamber 21 can be any well-known device for imposing an electric charge on gas entrained particles, for example, a Cottrell precipitator. Some of the larger charged particles are collected by electrostatic atraction on the walls of the corona chamber 21; however, most of the smaller particles remain entrained in the gas. The walls of the corona chamber 21 are washed, continuously or intermittently, with a liquid to remove the particles therefrom. The spent wash water and particles collected from the corona chamber walls drain through a second drain pipe 23, which is connected between the corona chamber 21 and the first drain pipe 15, into the collecting tank 17 as shown by arrow 22.

The gas and particles which remain entrained in the gas flow from the corona chamber 21 through a second connecting pipe 25 into a spray tower 27 as shown by arrow 24. A cleansing liquid is injected into the upper portion of the spray tower 27 in such a manner that droplets of the liquid are formed. The gas and entrained particles move upwardly, as viewed in FIG. 1, through the spray tower and contact the liquid droplets as they fall through the spray tower under the influence of gravity. In order to enhance the particle collection efficiency, the droplets of cleansing liquid are charged by a second power supply 26 to an electrical potential different from the negative potential imposed upon the particles in the corona chamber 21. In a preferred embodiment, the droplets are charged to a positive potential in the range of +1 to +20 Kilovolts (Kv), although the droplets can be charged to a potential having the same sign but a different value from the charged particles. As the liquid droplets move downwardly through the spray tower 27, they come in contact with the gas and entrained charged particles moving through the spray tower 27. The negatively charged particles are attacted to the positively charged droplets and collect on the droplets. As the droplets fall to the bottom of the spray tower 27, they carry the collected particles with them. The droplets and particles drain from the bottom of the spray tower 27 through a third drain pipe 29 into the first drain pipe 15 and in turn into the collecting tank 17. The gas continues through the spray tower 27 and exits from the top of the spray tower 27 through outlet pipe 31 into a mist eliminator 33. Spray droplets not removed from the gas stream by gravity and/or wall impaction in the spray tower 27 are removed in the elctrostatic type mist eliminator 33. As the droplets enter the mist eliminator 33, they are charged by discharge rods (not shown) suspended within the mist eliminator 33 which discharge rods are charged to a high positive potential by a third power supply 28. The charged droplets are attracted by and collect upon grounded stainless steel collection surfaces (not shown) within the mist eliminator 33 and are thereby removed from the gas stream. To prevent the liquid removed from the gas stream by the mist eliminator from interferring with the action of droplets in the spray tower 27, a catch basin (not shown) can be installed at the bottom of the mist eliminator 33 to route the removed liquid to the spray tower wall, allowing it to flow down the wall and into the third drain pipe 29. The cleansed gas then leaves the top of mist eliminator 33 through an exhaust pipe 35 and can be released into the open air as shown by arrow 30. It will be appreciated by those skilled in the art that while in the illustrated embodiment the spray tower is upright and the mist eliminator is located above the spray tower, it is also possible to orient the spray tower other than upright, e.g., horizontally. In such an instance the mist eliminator would not necessarily be located above the spray tower. The only requirement is that the mist eliminator be located downstream, in terms of the flow of the polluted gas, from the spray tower.

The liquid which is used to wash the gas in the cooling chamber 13 and to wash the walls of the corona chamber 21 can be provided from any source of liquid which is desired. As a matter of economic efficiency, it is preferable to recycle the water which is drained into collecting tank 17 for use as the wash water in the system. A pump 37 has a suction line 39 connected to the collecting tank 17. The pump 37 removes liquid from the collecting tank 17 and pumps it through wash water piping 41 as shown by arrows 40*a* and 40*b* to the first and second branch pipes 43 and 45, respectively, which in turn pass the liquid into the cooling chamber 13 and corona chamber 21 as shown by arrows 44*a* and 44*b*. A valve 47 is placed in the fluid path through the first branch pipe 43 to control the flow of liquid through the branch pipe 43. Similarly, a valve 49 is placed in the fluid path through the second branch pipe 45 to control the flow of liquid through the branch pipe 45 into corona chamber 21.

The scrubbing liquid is introduced into the upper portion of the spray tower 27 by means of first and second spray nozzles 51*a* and 51*b* respectively. A valve 53*a* is installed upstream of the first spray nozzle 51*a* to control the flow of scrubbing liquid to the spray nozzle 51*a*. Similarly, a valve 53*b* is installed upstream of the second spray nozzle 51*b* to control the flow of scrubbing liquid to the second spray nozzle 51*b*. The valves 47, 49, 53*a* and 53*b* can be any suitable type of valve, for example, a hand operated ball valve or an electrically operated valve. The scrubbing liquid is supplied to the spray nozzles through a supply line 55 as shown by arrow 56.

The scrubbing liquid can be supplied to the spray tower from any source of conductive liquid; however, it is again preferred for economic efficiency and operating efficiency to recycle liquid from the collecting tank 17 for use as the scrubbing liquid. By recycling the liquid used in the system, less liquid is used, thereby reducing operating costs. Also, it has been found that a higher conductivity liquid provides a more efficient collecting droplet for a given electrostatic potential. Although much of the insoluble particulate matter removed from the gas stream has been removed from the scrubbing liquid by setting action within the collecting tank 17, enough soluble and insoluble particulate matter remains in the spent scrubbing liquid to raise its conductivity. Therefore, the most efficient source of high conductivity scrubbing liquid is the collecting tank 17.

The charge can be imposed upon the scrubbing liquid at any place along its path from the supply to the spray nozzles 51*a* and 51*b*. The charge imposed upon the scrubbing liquid will flow upstream to the source of the liquid unless a means of electrically isolating the source of the liquid from the charged liquid is provided. Since the collecting tank 17 is grounded and the liquid collected within the tank 17 is at ground potential, it is necessary to electrically isolate the liquid in the supply line 55 from the liquid in the wash water piping 41. Electrical isolation is achieved by utilizing the isolating system 57 of the present invention.

A sump inlet pipe 59 is tapped off from the wash water piping 41 and supplies liquid to a sump 61 as shown by arrow 60. The liquid is injected into the sump 61 by a sump spray nozzle 63 which provides an interrupted stream of liquid into the sump, thereby preventing an electrical path from forming between the liquid within the sump 61 and the collecting tank 17. The liquid is removed from the sump 61 by a nongrounded pump 65 and fed to the supply line 55 by a sump outlet pipe 67. The sump 61 isolates the liquid within it from ground either by constructing the sump 61 of nonconductive material or by mounting the sump on an isolated, nonconductive platform.

In certain circumstances it is desirable to inject droplets having no electrical charge into the spray tower 27 to assist the interaction between the charged droplets and charged particles. This is accomplished by allowing a portion of the wash water to flow from the wash water piping 41 through a third branch pipe 69 to third and fourth spray nozzles 71*a* and 71*b* located within the spray tower 27 adjacent the first and second nozzles 51*a* and 51*b*. Valves 73*a* and 73*b* are installed upstream of the third and fourth spray nozzles 71*a* and 71*b*, respectively, and control the flow of liquid to the third and fourth spray nozzles. A makeup water inlet pipe 74 is connected to the collecting tank 17. Makeup water flows from a source (not shown) to the collecting tank 17 through the inlet pipe 74 to maintain a predetermined level of water in the collecting tank 17. It will be appreciated by those skilled in the art that all valves, piping, fittings, and gauges which come in contact with the charged scrubbing liquid must be constructed so as to electrically isolate the charged scrubbing liquid both to prevent shock hazards to personnel and to prevent current flow from the charged liquid to ground.

Figure 2:
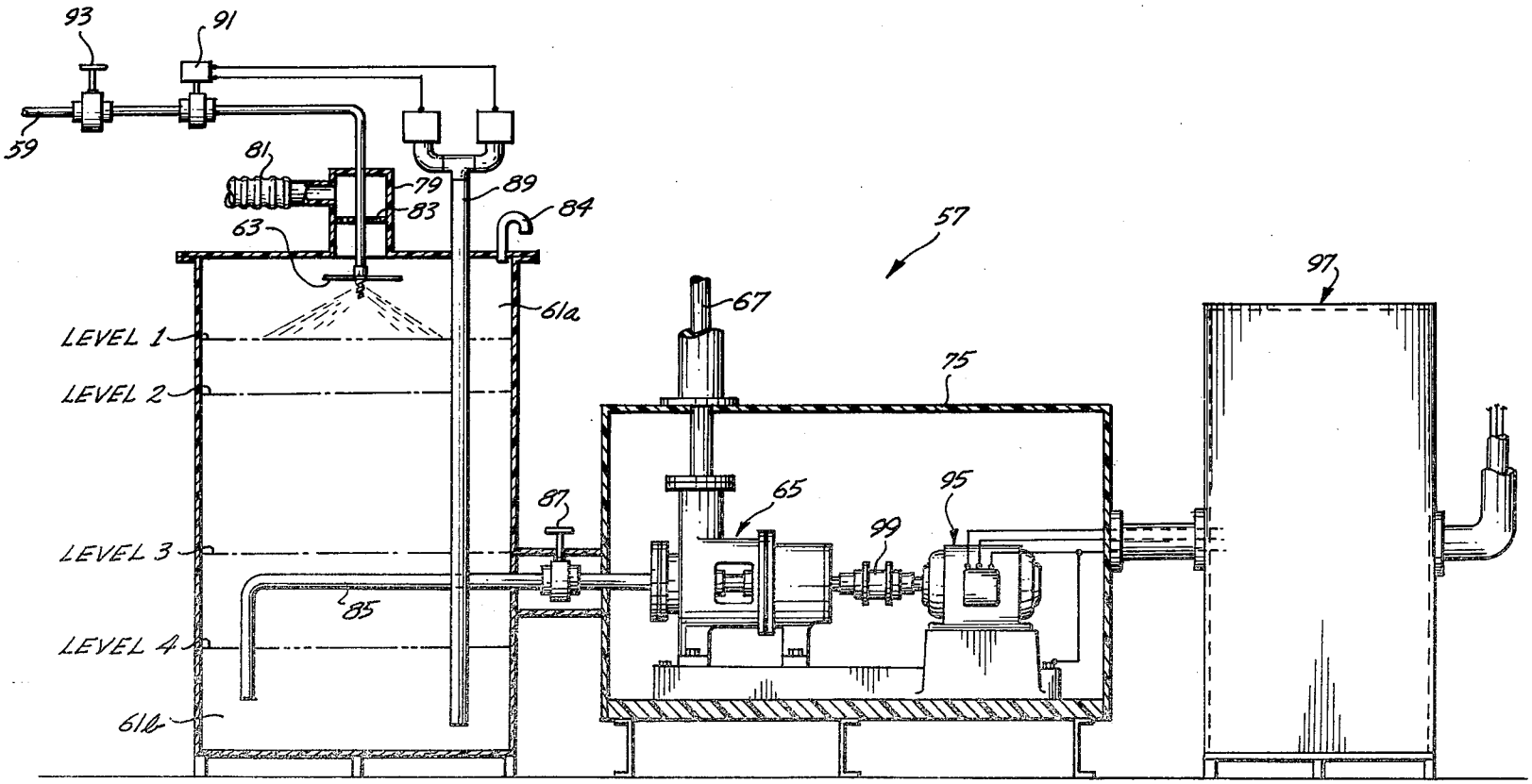
FIG. 2 is a diagram of a liquid transfer system constructed in accordance with the principles of this invention.

Referring now to FIG. 2, the liquid used in the system described above is electrically conductive, for example, water containing dissolved salts from a normal city water supply or recycled scrubbing liquid containing some of the particles removed from the gas stream. The charge placed on the cleansing liquid in supply line 55 will necessarily flow back to the pump 65 and through the pump 65 into the liquid within the sump 61. As mentioned above, the liquid within the sump 61 is isolated from ground by constructing the sump of nonconductive material. Alternatively, if the sump walls were constructed of a conductive material, the sump 61 could be mounted on a platform (not shown) that is constructed of a nonconductive material. The nonconductive platform would isolate the walls of the sump from ground. The pump 65 must be installed electrically isolated from ground to prevent the charge on the liquid within supply line 55 from dissipating to ground. Also, in the case illustrated, the pump 65 is at the high positive potential of the scrubbing liquid. It is therefore preferably to enclose the pump 65 within a nonconductive housing 75 constructed of an electrically nonconductive material, for example fiberglass reinforced plastic (FRP). Since the liquid which is within the sump 61 carries a high positive potential and the liquid in the wash water piping 41 is at ground potential, it is necessary that the means of introducing the grounded liquid into the sump 61 be electrically isolated from the liquid within the sump 61 to prevent a dissipation of the charge to ground or a possible electrical shock hazard to operating personnel. The liquid is injected into the sump 61 through the sump spray nozzle 63 which is attached to one end of the sump inlet pipe 59 within an upper portion 61*a* of the sump 61. The spray nozzle 63 introduces the liquid in an interrupted stream, for example a plurality of separate droplets, thereby breaking what would otherwise be a continuous path of the fluid between the sump inlet pipe 59 and the liquid already within the sump 61. The nozzle 63 can be any well known nozzle, for example, a helical ½" nozzle of polytetrafluraethylene as manufactured by Bete Nozzle Co., of Greenfield, Mass., their model No. TF24FLN, so long as the nozzle provides the liquid in an interrupted stream to the sump 61.

A purge air chamber 79 is located on top of the sump 61 and opens into the sump 61. The sump inlet pipe 59 passes through the purge air chamber 79 prior to its entry into the sump 61. A purge air pipe 81 is fluidly connected to the purge air chamber 79 and provides an inlet for heated purge air to maintain the sump inlet pipe and nozzle 63 in a dry state, thereby preventing any electrical conduction by means of a liquid path formed along the walls of the sump 61 and coming in contact with the sump inlet pipe 59 or the nozzle 63. A baffle plate 83 having a plurality of holes formed therein surrounds the sump inlet pipe 59 intermediate the purge air pipe 81 and the nozzle 63. The heated purge air enters the purge air chamber 79 and passes through the holes in the baffle plate 83 to surround the end of the sump inlet pipe 59 and the nozzle 63. An exhaust pipe 84 is connected to a top wall 61*c* of the sump 61 in fluid communication with an opening provided in the top wall 61*c* of the sump 61. Spent purge air exhausts from the sump 61 through opening and the exhaust pipe 84 to the open air. The walls of the sump 61, the purge air chamber 79 and the baffle plate 83 are all constructed of electrically nonconductive material, for example fiberglass reinforced plastic (FRP) or polyvinyl chloride (PVC). The heated purge air serves a second purpose by drying the area adjacent the nozzle thereby preventing any buildup of particles which may collect on the spray nozzle from the recirculated liquid from collecting tank 17.

The liquid is removed from the sump 61 through a suction pipe 85, one end of which is located within the nonconductive sump lower portion 61*b* and the other end of which fluidly communicates with the pump 65. A valve 87 is installed in the fluid path of the suction pipe 85 to control the flow of fluid through the suction pipe 85.

A liquid level sensor 89 is installed within the sump 61 to detect the liquid level within the sump. The output of the level sensor 89 is used to control a valve 91 located in the fluid path of the sump inlet pipe 59 upstream of the spray nozzle 63. The purpose of the level sensor 89 is to maintain the liquid level within the sump at an optimum level so that there is always a sufficient supply of liquid for the spray tower. The desired level of liquid is denoted by the lines marked Level 2 and Level 3 in FIG. 2. When the sensor 89 detects that the level of liquid within the sump 61 is below the lower boundery of the optimum level, i.e., the level denoted Level 3, it opens the valve 91 to allow liquid to enter the sump 61. When the sensor 89 detects the level of the liquid to be above the upper boundary of the optimum level, i.e., level denoted Level 2 in FIG. 2, it closes the valve 91 to prevent the liquid level from becoming high enough to cause an arc between the spray nozzle 63 and the charged liquid within the sump 61. Should the liquid level rise to the level where there is significant danger of an arc, shown as Level 1 in FIG. 2, an emergency shutdown occurs which closes valve 91 and shuts down the pumps to prevent an overcurrent condition which would occur should the electrically charged fluid contact the grounded spray nozzle 63. Also, should the liquid level fall to below the level, a level near the inlet end of the suction pipe, shown as Level 4 in FIG. 2, an emergency shutdown of the pump takes place to prevent the liquid level from dropping below the inlet end of the suction pipe 85, causing the pump 65 to run dry and possibly causing mechanical damage to the pump mechanism. In addition, a signal denoting that the liquid is at Level 1 or Level 4 will cause charging power supply 26 to shutdown, preventing any possible electrical arcing between the charged liquid in the sump and the grounded incoming liquid.

A manually operated valve 93 can be installed in the sump inlet pipe 59 upstream of the valve 91. The valve 93 is used to vary the rate of flow through sump inlet pipe 59 to control the time it takes for the sump to fill when valve 91 is open. It is, of course, necessary that the flow of fluid into the sump 61 through the sump inlet pipe 59 is at a rate greater than the flow of fluid out of the sump 61 through the pump 65 to insure that there is always a supply of scrubbing liquid to supply line 55 and in turn spray nozzles 51*a* and 51*b* whenever the electrostatic scrubber is in operation.

The pump 65 can be any conventional pump. In a preferred embodiment of the invention the pump 65 is driven by an electric motor 95. The electric motor 95, by its connection to pump 65, is necesarily at the same high positive potential as the pump 65. Electrical isolation of the motor from its power source is necessary to prevent the imposition of the high positive potential of the pump, liquid and motor onto the input power lines to the motor unit. The preferred means of isolation is an AC motor which is connected to its power source through an isolation transformer 97 with a DC isolation factor between the primary and secondary windings of the transformer large enough to isolate the power source from the high potential of the pump 65 and the motor 95. One example of a motor and isolation transformer system is manufactured by Tierney Electric Co. of seattle, Wash., and includes a 1:1 ratio isolation transformer which has an input to the primary winding of 440 volt, three phase AC and an output from the secondary winding of 440 volt, three phase AC which runs a three phase AC electric motor. The transformer has a DC isolation between the primary and the secondary windings capable of withstanding 35 Kilovolts (Kv) without breakdown. Other methods of isolating the pump from its drive source could be used. For example, a belt-driven pump could be provided having a nonconductive drive belt connecting the drive motor to the pump, or the coupling 99 between the drive shaft of the motor 95 and the drive shaft of the pump 65 could be made of a nonconductive material thereby isolating the drive motor from the pump housing, or the pump could be air driven having a nonconductive air supply hose using clean air.

Referring now to FIG. 3, the purge air chamber 79 is attached to a top wall 61*c* of the sump 61. The purge air chamber 79 opens into the sump 61 through an aperture 101 formed in the top wall 61c. The sump inlet pipe 59 is attached to a 90° elbow joint 103 which in turn is attached to a sump entry pipe 105. The sump entry pipe 105 extends downwardly from the elbow joint 103 and passes through an opening formed in a top wall 79a of the purge air chamber 79 and extends into the sump 61 through the aperture 101. The spray nozzle 63 is attached to the lower end of the entry pipe 105 within the upper portion 61a of the sump 61. The purge air pipe 81 is attached to a sidewall 80 of the purge air chamber adjacent an upper portion 79b of the purge air chamber. The purge air pipe 81 is in fluid communication with the purge air chamber through an opening 109 formed in the sidewall 80 of the purge air chamber 79. The nonconductive baffle plate 83 is mounted within the purge air chamber 79 generally orthogonal to and surrounding the entry pipe 105 and located intermediate the opening 109 and the top wall 61c. The baffle plate 83 is supported by a nonconductive sleeve 107 which is mounted on the interior of the purge air chamber 79 supported by the top wall 61c. A plurality of apertures 111 are formed through baffle plate 83 to allow the heated purge air to pass from the purge air pipe 81 into the upper portion 79b of the purge air chamber and through the apertures 111 into the lower portion 79c of the purge air chamber surrounding the entry pipe 105 causing any moisture to evaporate and any particles to be removed by the airflow. It is possible to use any clean nonconductive gas to perform the purging function, however, it is most economical to use air which has been filtered to remove any contamination and then heated to enhance its drying properties. A deflector plate 115 of nonconductive material is mounted orthogonally to the entry pipe 105 adjacent and above the spray nozzle 63. The deflector plate 115 prevents any upwardly directed backspray from the nozzle 63 from wetting the top wall 61c or the interior of the purge air chamber 79. Also, the deflector plate 115 deflects the purge air flowing down from baffle plate 83 so that it is directed along the inner surface of the top wall 61c of the sump 61 to dry the top wall. The interior of the purge air chamber 79 is preferably lined by a liner 113 constructed of polytetrafouroethylene or some similar material which resists wetting thereby decreasing the amount of moisture which will collect on the interior walls.

Referring now to FIGS. 4 and 5, the spray tower 27 is a generally upright cylindrical chamber containing a rectangular network of pipes which carry the scrubbing liquid within the spray tower. Four scrubbing liquid charging units 117a, 117b, 117c and 117d are mounted on an upper portion 27a of the spray tower. The construction of the charging units 117a–d will be described later. The scrubbing liquid which is to be charged enters the charging unit 117a through an inlet pipe 119. The charged fluid is then distributed by feeder pipe 121 to the network of pipes and spray nozzles within the spray tower 27. The charged spray nozzles 123 are arranged in groups defining a series of four horizontally oriented planes vertically spaced along the length of the spray tower 27. In the illustrated embodiment, each group of charged spray nozzles 123 comprises nine nozzles arranged in a three by three matrix. The charged liquid is fed to the charged spray nozzle groups by vertically oriented pipes 125a, 125b, 125c and 125d which are fluidly coupled to feeder pipe 121. The vertically oriented pipes 125a–d are joined by horizontally oriented pipes 127a, 127b, 127c, and 127d as viewed in FIG. 4 and by a similar series of horizontal pipes which are not illustrated because of the particular section of the spray tower which is illustrated. In order to achieve a uniform coverage of the space within the spray tower with the liquid droplets, the uppermost group of spray nozzles is directed downwardly and the three remaining groups of spray nozzles are directed upwardly.

As noted earlier, it is sometimes desirable to inject a spray of neutrally charged droplets into the spray tower to aid in particle collection efficiency. The neutral liquid enters the spray tower 27 through a lower inlet pipe 129 which is mounted in a lower portion 27b of the spray tower and passes through an opening in the spray tower wall. The neutral liquid is distributed by a series of vertical pipes 131 and horizontal pipes 133 which are generally adjacent to the vertical and horizontal pipes 125 and 127, respectively, hereinbefore described which contain the charged liquid. The neutral liquid is injected into the spray tower by a plurality of neutral spray nozzle 135 which are mounted on the horizontal pipes 133 in juxtaposition to the charged spray nozzles 123. Since the neutral liquid and the walls of the spray tower are both at ground potential, the horizontal pipes 133 can be mounted directly on the spray tower walls without any consideration to electrical conductivity between the neutral liquid and the walls.

Figure 6:
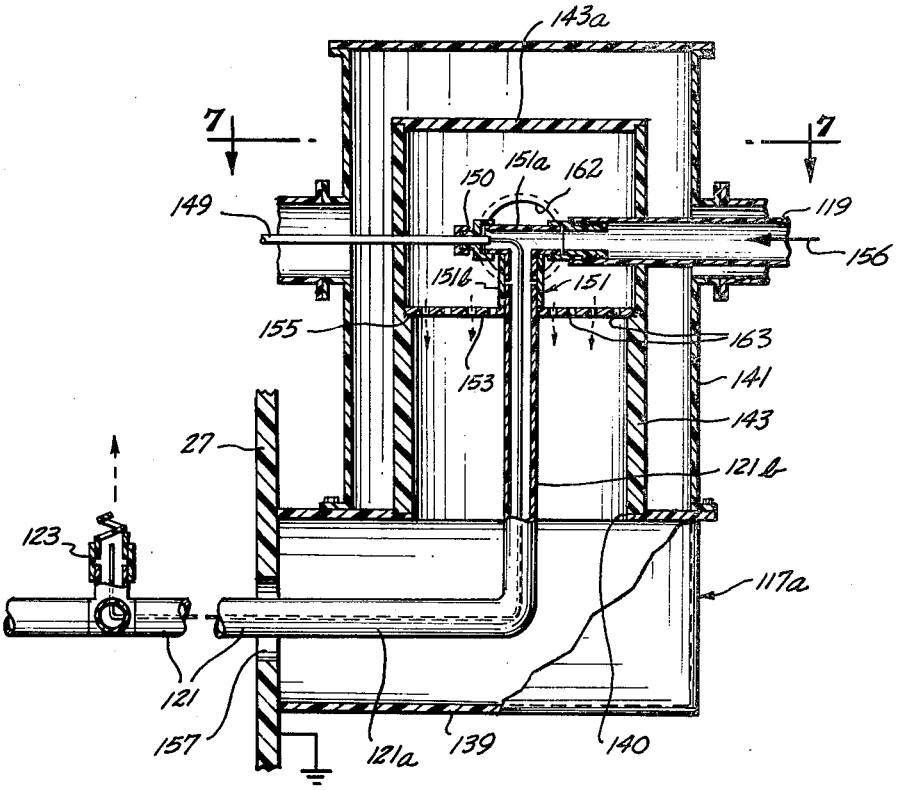
FIG. 6 is a simplified side elevational view partly in section of the charged spray inlet of the wet electrostatic scrubber spray tower shown in FIGS. 4 and 5.
Figure 7:
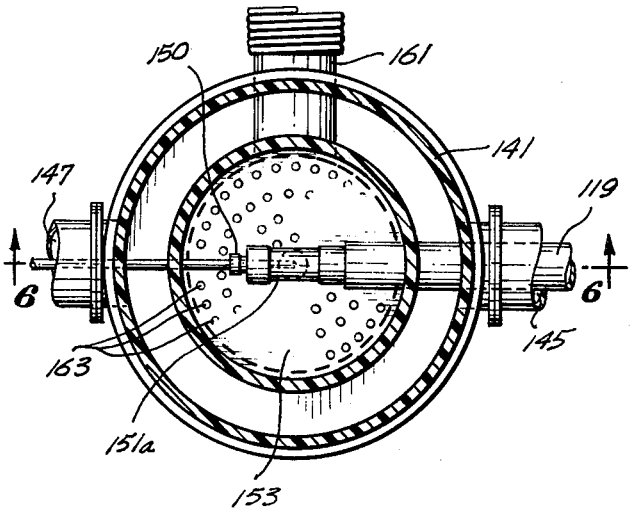
FIG. 7 is a plan view of the charged spray inlet shown in FIG. 6.

Referring now to FIGS. 6 and 7, the charging unit 117a includes a generally horizontally oriented first cylindrical portion 139 attached to and extending outwardly from the exterior of the spray tower wall adjacent the upper portion 27a of the spray tower 27. A generally vertically oriented second cylindrical portion 141 extends upwardly from the outer end of the first cylindrical portion 139. The cylindrical portions 139 and 141 are hollow and the first cylindrical portion 139 is in fluid communication with the interior of the spray tower 27 through an opening 157 in the spray tower wall. A hollow cylindrical interior tube 143 of diameter smaller than the diameter of the second cylindrical portion 141 is located within and parallel to the second cylindrical portion 141. The lower end of the interior tube 143 abuts and is supported by the horizontally oriented first cylindrical portion 139. The interior tube 143 is in fluid communication with the first cylindrical portion 139 through an opening 140 formed in the wall of the first cylindrical portion 139 in registry with the interior of the interior tube 143. The top end of the interior tube 143 is closed by a topwall 143a.

A horizontal portion 121a of the spray tower feeder pipe 121 extends from the spray nozzles within the spray tower through the opening 157 in the spray tower wall and into the first cylindrical portion 139. The feeder pipe 121 bends upwardly within the first cylindrical portion 139 and a vertical portion 121b of the feeder pipe extends upwardly through the opening 140 in the wall of the first cylindrical portion 139 into the interior tube 143. The feeder pipe 121 terminates within the interior tube 143 and is threadably engages the lower end of the vertical shank portion 151b of a T-coupling 151. The upper end of the shank portion 151b connects to a horizontal cross-bar portion 151a and the lower end of the shank portion 151b abuts a support plate 153 which is orthogonal to and surrounds the feeder pipe 121. The support plate 153 is in turn supported along its periphery by an inwardly extending shoulder 155 extending circumferentially around the inner surface of the interior tube 143.

One end of the cross bar portion 151a of the T-coupling threadably engages the inlet pipe 119 from the sump 61. The inlet pipe 119 passes through aligned openings in the sidewalls of the interior tube 143 and the second cylindrical portion 141 of the charging unit 117*a*. The other end of the cross-bar portion 151*a* of the T-coupling 151 receives a conductor 149 from the charging power supply 26. The conductor 149 passes through opening in the sidewalls of the first horizontal portion 141 and the interior tube 143 that are aligned with one another and with the end of the crossbar portion 151*a* of the T-coupling. The conductor 149 extends downwardly through the shank portion of the T-coupling through the feeder pipe 121 and terminates adjacent the nozzle 123. A fitting 150 surrounds the conductor 149 adjacent the T-coupling 151 and engages the end of the I-coupling so as to form a fluid seal around the conductor 149. The conductor 149 is insulated along its extension from the power supply to a point within the T-coupling 151. The conductor is bare, i.e., uninsulated, along its extension through the shank portion 151*b* and the feeder pipe 121.

The liquid to be charged flows into the charging unit 117*a* through the inlet pipe 119 in the direction shown by arrow 156 into the horizontally oriented crossbar portion 151*a* of the T-coupling 151 and down the shank portion 151*b* to the vertical portion of the feeder pipe 121. Within the T-coupling 151 and feeder pipe 121, the liquid contacts the bare charge conductor 149 and acquires an electric potential. The feeer pipe 121 then distributes the charged liquid to the charged liquid spray nozzles 123. The charge on the liquid within the charging unit 117*a* flows upstream to the liquid within the sump 61 which is the supply of liquid to the charging unit. However, the liquid is electrically isolated by the sump 61 and spray nozzle 63 from the grounded collecting tank 17 as hereinbefore described.

It is necessary to prevent the formation of a conductive path between the grounded spray tower walls and the liquid within the feeder pipe 121 to prevent the charging power supply (not shown) from being overloaded. To accomplish the isolation of the charged liquid from the grounded spray tower walls, the feeder pipe 121, the inlet pipe 119 and the T-coupling 151 are all constructed of nonconductive material, for example polyvinyl chloride (PVC). The feeder pipe 121 is supported by the T-coupling 151 which in turn is supported by the support plate 153. The support plate is positioned so that as the feeder pipe 121 passes through the opening 157 in the spray tower wall, the feeder pipe is centered in the opening and does not contact the spray tower wall. The support plate 153 and the interior tube 143 are also constructed of nonconductive materials. The interior tube 143 and support plate 153 must be constructed of a material with enough strength and rigidity to support the feeder pipe 121 and the liquid distribution piping within the spray tower 27 which is connected to the feeder pipe 121. A similar supporting structure is present in each of the charging units 117*a*, 117*b*, 117*c* and 117*d* so that the piping network within the spray tower 27 is supported at four points around the spray tower 27.

One possible electrical path which may be formed between the liquid within feeder pipe 121 and the grounded walls of the spray tower 27 is by way of a film of moisture which condenses on the exterior of the feeder pipe 121, the interior walls of the interior tube 143 and the lower cylindrical portion 139 and also on the undersurface of the support plate 153. To prevent such a path from forming, a stream of heated purge air is routed through the charging unit 117 and around the feeder pipe 121 to evaporate any moisture which may condense on the exposed surfaces. The heated purge air enters the charging unit through an air inlet pipe 161 which passes through an opening in the wall of the upper portion 141 and is fluidly coupled to an opening 162 formed in the wall of the interior tube 143 directly behind (as viewed in FIG. 6) the T-coupling 151. The heated purge air flows into the upper portion of the interior tube 143 and passes through a plurality of openings 163 formed in the support plate 153 to the lower portion of the interior tube 143 and the lower cylindrical portion 139 thereby surrounding the feeder pipe 121 with a flow of heated purge air.

It will be appreciated by those skilled in the art and others that an apparatus for transferring a liquid from a source of supply at a first electrical potential to a receiving equipment in which the liquid will be charged to a second electrical potential, which transfer system isolates the liquid at the second potential, from the liquid at the first potential has been described and illustrated. Although the liquid transfer system of the present invention has been described in conjunction with a wet electrostatic scrubber, the transfer system can be used in any environment in which a conductive liquid is charged to a high electrical potential and must be separated from a reservoir of liquid at a ground potential for example, a charge bubble scrubber. Although in the described embodiment the transfer system was used to transfer a liquid, it is also possible to use the transfer system of the present system to transfer a slurry. For example, in the combined control of particulate and sulfur dioxide emissions from coal-fired power plants, the exhaust gases would most likely be conducted with droplets of a limestone slurry. It will also be appreciated by those skilled in the art and others that although a preferred embodiment of the liquid transfer system of this invention has been described and illustrated, many changes can be made to the apparatus while remaining within the scope of the present invention. For example, instead of using a nonconductive pipe of polyvinyl chloride for transferring the liquid, it is possible to use a more structurally rigid pipe such as stainless steel lined with plastic to prevent electrical conductivity between the liquid within the pipe and the steel wall of the pipe. Also, as hereinbefore mentioned, although an electric motor-driven pump was described and illustrated, it is possible to use a belt-driven pump (in conjunction with a nonconductive drive belt) or even an air motor which is electrically isolated from the pump housing.

The embodiments of the invention in which an exclusive property or privilege is claimed are defined as follows:

I claim:

1. A method of transferring a conductive liquid at a first electrical potential from a supply to receiving equipment which charges the liquid to a second electrical potential, and electrically isolating the liquid at said second potential from the liquid at said first potential, comprising the steps of:

(a) introducing liquid from said supply into an electrically nonconductive container through a spray means in an interrupted stream;

(b) electrically isolating said container from said first potential;

(c) transferring the liquid from said container to said receiving equipment through a pump;

(d) electrically isolating said pump from said first potential.

2. The method of claim 1 further including the step of introducing a stream of nonconductive gas into said container and deflecting the gas stream to flow around said spray means and along the portion of said container adjacent said spray means to prevent accumulations of liquid on said spray means and said portion of said container.

3. In an electrostatic gas scrubber having means for imposing an electrostatic charge upon particulate matter contained in a gaseous stream, means for introducing said gaseous stream into a spray chamber, and liquid spray means to disperse droplets of a conductive liquid into said chamber, said liquid having an electrostatic charge imposed thereon whereby said gaseous stream contains charged liquid droplets, a method for recycling said conductive liquid comprising the steps of:

(a) collecting said conductive liquid from said spray chamber in a grounded container;

(b) transferring said conductive liquid from said container to a sump having nonconductive walls through an inlet in said sump along a nonconductive flow path;

(c) electrically isolating said sump from ground;

(d) transferring said conductive liquid from said sump to said liquid spray means through a pump;

(e) electrically isolating said pump from ground;

(f) causing a stream of nonconductive gas to flow into said sump and deflecting said nonconductive gas stream to flow along the portion of the walls of the sump adjacent said inlet to prevent accumulation of said conductive liquid on said portions of said walls.

4. The method of claim 3 further comprising the steps of:

sensing the level of liquid within said sump; and stopping the flow of liquid into said sump when the sensed level of liquid reaches a predetermined level.

5. An apparatus for transferring a conductive liquid at a first electrical potential from a supply means constructed and arranged to hold said liquid at said first potential to receiving equipment which charges the liquid to a second electrical potential, and for electrically isolating the liquid at said second potential from the liquid at said first potential comprising;

an electrically nonconductive containment means for holding liquid at said second potential, said containment means having sidewalls, a top wall, an inlet adjacent said top walls, and an outlet, and being electrically isolated from said first potential;

spray means constructed and arranged with respect to said inlet and electrically isolated from said second potential to introduce said liquid at said first potential into said containment means in an interrupted stream from an opening in said spray means;

airflow means constructed and arranged to introduce a stream of nonconductive gas into said containment means through said inlet;

deflection means within said containment means constructed and arranged to direct said gas stream along the top wall and those portions of the sidewall adjacent said top wall of said containment means to prevent liquid at said first potential from accumulating on the portion of said containment means adjacent said inlet; and, mechanical pump means for transferring liquid from said containment means to said receiving equipment, said pump means having a suction inlet in fluid communication with said outlet, said pump means being electrically isolated from said first potential.

6. The apparatus defined in claim 5 wherein said supply means is so constructed and arranged that said first potential is ground.

7. The apparatus defined in claim 5 wherein said spray means is operably coupled to an inlet conduit, said inlet conduit being in fluid communication with said supply means said spray means being positioned within said containment means adjacent said inlet, said inlet including an entrance channel, said inlet conduit extending through and being spaced from said channel, said airflow means directing said nonconductive gas through said channel and around said inlet conduit and nozzle means.

8. The apparatus defined in claim 5 wherein said pump means comprises:

a pump and an AC electric motor for driving said pump, and means for DC isolating said electric motor from its AC power source.

9. The apparatus defined in claim 8 wherein said means for DC isolating comprises an isolation transformer.

10. The apparatus defined in claim 5 wherein said deflection means includes a deflector plate mounted on said spray means intermediate said top wall and said opening in said spray means.

11. In an electrostatic gas scrubber having means for imposing an electrostatic charge upon particulate matter contained in a gaseous stream, means for introducing said gaseous stream into a spray chamber, and liquid spray means to disperse droplets of a conductive liquid into said chamber, said liquid having an electrostatic charge imposed thereon whereby said gaseous stream contains charged liquid droplets, the improvement comprising a system for recycling said conductive liquid, said improved recycling system including;

an electrically grounded collecting means for collecting said conductive liquid from said spray chamber;

a sump constructed of nonconductive material and isolated from ground and having an inlet and an outlet therein;

transfer means positioned and arranged with respect to said collecting means and said sump to transfer said liquid from said collecting means to said sump, said transfer means including spray means positioned and arranged with respect to said inlet to inject said liquid from said grounded collecting means into said sump along a nonconductive flow path;

gas flow means for introducing a stream of nonconductive gas into said sump through said inlet to prevent the buildup of conductive liquid on the portions of said sump adjacent said inlet; and, mechanical pump means isolated from ground for transferring said conductive liquid from said sump to said liquid spray means in said spray chamber, said pump having a suction inlet in fluid communication with said outlet.

12. The gas scrubber recited in claim 11 wherein said recycling system further comprises sensor means constructed and arranged with respect to said sump to sense the level of liquid within said sump; and valve means constructed and arranged with respect to said inlet and said sensor means to be responsive to said sensor means so as to stop the flow of liquid into said sump through said inlet when the level of liquid sensed by said sensor means reaches a predetermined level to prevent formation of a conductive path between the liquid within the sump and the spray in said spray means chamber.

13. The apparatus defined in claim 11 wherein said mechanical pump means comprises a pump, an AC electric motor for driving said pump and means for DC isolating said electric motor from its AC power source.

14. The apparatus defined in claim 13 wherein said means for DC isolating comprises an isolation transformer.

15. Apparatus for introducing a conductive liquid at a first electrical potential into a container enclosing liquid at a second electrical potential, said container having an inlet, said apparatus electrically isolating the liquid at said first potential from the liquid at said second potential, comprising:

spray means operably associated with said inlet for injecting the liquid at said first potential into said container in an interrupted flow stream;

airflow means for introducing a stream of nonconductive gas into said container through said inlet; and, deflector means within said container constructed and arranged to direct the stream of nonconductive gas along the portions of said container adjacent said inlet to prevent liquid at said first potential from accumulating on said portions of said container.

16. The apparatus defined in claim 15 wherein said spray means is in fluid communication with an inlet conduit, said spray means being positioned within said container adjacent said inlet, said inlet including an entrance channel, said inlet conduit extending through and being spaced from said channel, said air flow means directing said nonconductive gas through said channel and around said inlet conduit and said spray means.

17. The apparatus defined in claim 16 wherein said deflector means comprises a deflector plate mounted on said inlet conduit adjacent said spray means.

* * * * *